US006269788B1

(12) United States Patent
Kachelek

(10) Patent No.: US 6,269,788 B1
(45) Date of Patent: Aug. 7, 2001

(54) PROGRAMMABLE COMPUTER CONTROLLED ELECTRIC OIL PUMP DRIVE FOR ENGINES

(76) Inventor: Robert L. Kachelek, 1915 Tallgrass Cir., Waukesha, WI (US) 53188

( * ) Notice: Subject to any disclaimer, the term of this patent is extended or adjusted under 35 U.S.C. 154(b) by 0 days.

(21) Appl. No.: 09/524,475

(22) Filed: Mar. 13, 2000

(51) Int. Cl.[7] ..... F01M 1/00
(52) U.S. Cl. ..... 123/196 R; 123/196 S
(58) Field of Search ..... 123/196 R, 196 S

(56) References Cited

U.S. PATENT DOCUMENTS

| | | | | |
|---|---|---|---|---|
| 4,502,431 | * | 3/1985 | Lulich | 123/196 S |
| 5,315,971 | * | 5/1994 | Yamada | 123/196 R |
| 5,339,776 | * | 8/1994 | Regueiro | 123/196 CP |
| 5,474,428 | * | 12/1995 | Kimura et al. | 417/16 |
| 5,526,783 | * | 6/1996 | Ito et al. | 123/196 S |
| 5,630,383 | | 5/1997 | Kidera et al. | 123/73 AD |
| 5,749,339 | * | 5/1998 | Graham et al. | 123/73 AD |
| 5,884,601 | * | 3/1999 | Robinson | 123/196 A |
| 5,944,632 | | 8/1999 | Hara et al. | 477/158 |

* cited by examiner

*Primary Examiner*—Willis R. Wolfe
*Assistant Examiner*—Jason A Benton
(74) *Attorney, Agent, or Firm*—Donald J. Ersler

(57) ABSTRACT

A programmable computer controlled electric oil pump drive for engines includes an electric motor, coupler assembly, programmable controller, and mounting plate. A motor drive shaft of the electric motor is coupled to the pump drive shaft of the oil pump through the coupler assembly. The rotation of the electric motor is controlled by the programmable controller. The programmable controller is powered by an engine alternator. The programmable controller also receives a speed signal from a source in the engine electrical system. The programmable controller preferably supplies the electric motor with voltage according to a look-up table or an algorithm. The speed of the oil pump is adjusted according to the engine speed as defined by the look-up table or the algorithm. The speed of the electric motor may be monitored by the programmable controller. If the motor is not rotating or speed of motor is too slow, an audible alarm is provided. The programmable computer controlled electric oil pump drive for engines may be combined with an oil pump, an oil reservoir and connecting device for oil injection of non-oil injected engines.

16 Claims, 5 Drawing Sheets

PROGRAMMABLE COMPUTER CONTROLLED ELECTRIC OIL PUMP DRIVE FOR ENGINES

BACKGROUND OF THE INVENTION

1. Field of the Invention

The present invention relates generally to oil pumps and more specifically to a programmable computer controlled electric oil pump drive for engines which allows a lubrication system failure to be corrected quicker, more reliably, and more economically than a repair of the original system.

2. Discussion of the Prior Art

It is common for an oil drive gear to fail in an oil pump drive system of an outboard engine. The resulting failure is very costly to repair, because the drive gear is located on the crankshaft in an inaccessible part of the engine. Many hours are required to repair the failed oil gear which translates into a very expensive repair bill. Further, since some outboard engines use an unreliable plastic gear to drive the oil pump; multiple failures of the oil drive gear over the life of the outboard engine can occur.

Accordingly, there is a clearly felt need in the art for an programmable computer controlled electric oil pump drive for engines which may be easily installed, replicates the operation of the oil pump as originally installed and utilizes the warning protections which are part of the outboard engine.

SUMMARY OF THE INVENTION

The present invention provides an electric motor driven oil pump which acts as a replacement on engines having a gear driven oil pump. The electric motor driven oil pump may also be used to replace other lubrication systems, and to provide an oil injection system where none existed previously. According to the present invention, a programmable computer controlled electric oil pump drive for engines includes an electric motor, coupler assembly, programmable controller, and mounting plate. A motor drive shaft of the electric motor is coupled to the pump drive shaft of the oil pump through the coupler assembly. The rotation of the electric motor is controlled by the programmable controller. The programmable controller is powered by a battery. The programmable controller receives a speed signal from an alternator in the engine electrical system.

The coupler assembly includes a coupler housing, a coupler device, and a speed sensor. The coupler device has an embedded magnet. One end of the coupler device receives the motor drive shaft of the electric motor and the other end thereof receives the pump drive shaft of the oil pump. An opening is formed in a side of the coupler housing for insertion of the speed sensor. The magnet is located in the coupler device such that it closes one switch at a time in the speed sensor upon rotation of the coupler device. The result of the coupler device rotation is a change in the electrical signal output from the speed sensor.

The programmable controller preferably supplies the electric motor with voltage according to a look-up table or algorithm. The speed of the oil pump is adjusted according to the engine speed as defined by the look-up table or algorithm. The speed of the electric motor is monitored by the programmable controller through the speed sensor. If the speed is too low, the programmable controller will raise the value of voltage sourced to the electric motor. If the speed of the electric motor is too high, the value of the voltage sourced to the electric motor will be reduced. If the required speed is not reached, a motor drive circuit will cease supplying the electric motor with current, a warning signal will be sent and a horn activated when no rotation of the electric motor is sensed.

A first embodiment of the programmable computer controlled electric oil pump drive for engines is used on Mercury/Mariner outboard engines. The oil pump, coupler, and speed sensor from the engine are utilized. The warning signal and horn activation are implemented by the engine electrical system.

In a second embodiment, the programmable computer controlled electric oil pump drive for engines is used to provide an oil injection system on non-oil injected engines. An oil pump, oil reservoir, and connecting device are provided. The speed sensor and magnet are optional to facilitate a lubrication failure warning system, if desired.

Accordingly, it is an object of the present invention to provide a programmable computer controlled electric oil pump drive for engines which may be easily installed to replace a gear driven system.

It is a further object of the present invention to provide a programmable computer controlled electric oil pump drive for engines which may be conveniently serviced if a failure occurs with any component of the system.

It is yet a further object of the present invention to provide a programmable computer controlled electric oil pump drive for engines which may be substituted for an expensive repair to the oil pump drive system.

It is yet a further object of the present invention to provide a programmable computer controlled electric oil pump drive for engines which is more reliable than the oil pump drive/lubrication system in some engines.

It is yet a further object of the present invention to provide a programmable computer controlled electric oil pump drive for engines which may be programmed to deliver more or less oil according to the specific application of the outboard engine.

It is yet a further object of the present invention to provide a programmable computer controlled electric oil pump drive for engines which provides a failure warning where none previously existed.

Finally, it is another object of the present invention to provide a programmable computer controlled electric oil pump drive for engines which may be used in non-oil injected engines to provide oil injection.

These and additional objects, advantages, features and benefits of the present invention will become apparent from the following specification.

DETAILED DESCRIPTION OF THE PREFERRED EMBODIMENTS

Figure 1:
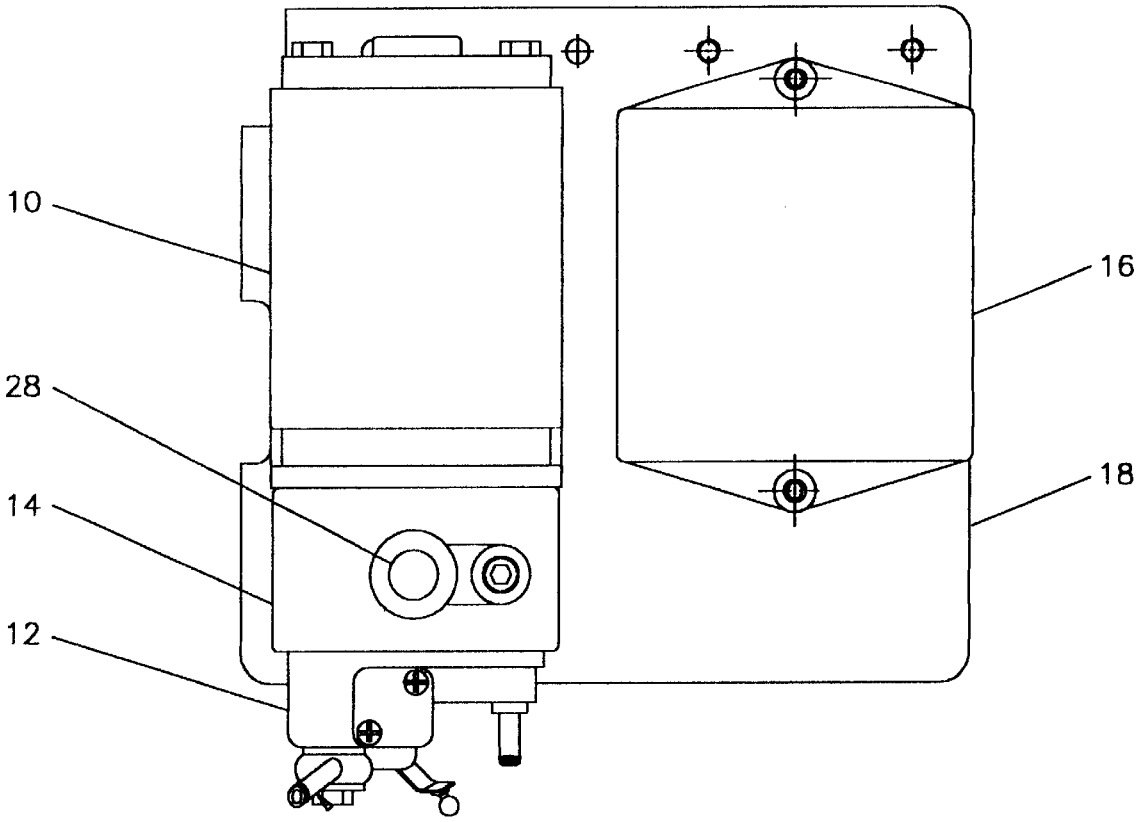
FIG. 1 is a front view of a programmable computer controlled electric oil pump drive for engines in accordance with the present invention.
Figure 2:
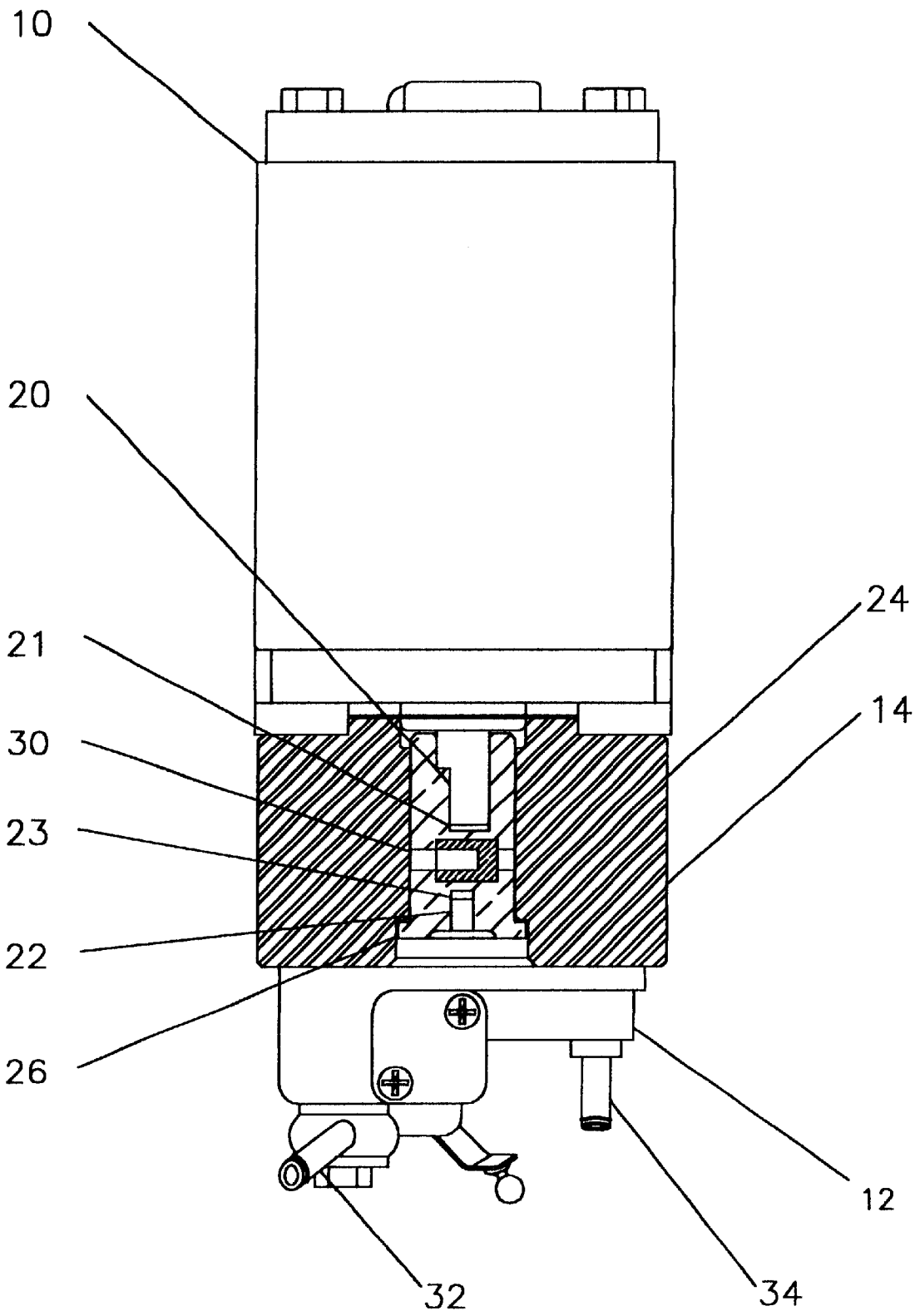
FIG. 2 is a cross-sectional view of a coupler housing and coupler device of a programmable computer controlled electric oil pump drive for engines in accordance with the present invention.

With reference now to the drawings, and particularly to FIG. 1, there is shown a front view of an electric motor driven pump for engines 1. With reference to FIG. 2, the electric motor driven pump for engines 1 includes an electric motor 10, oil pump 12, coupler assembly 14, programmable controller 16, and mounting plate 18. The coupler assembly 14 includes a coupler housing 24, coupler device 26, and a speed sensor 28. The electric motor 10 is attached to one end of the coupler housing 24 and the oil pump 12 is attached to the other end of the coupler housing 24. The electric motor 10 preferably runs on DC voltage. The coupler housing 24 is fastened to the mounting plate 18 with any suitable fastening method. An opening is formed through a wall of the coupler body 24 to accept the speed sensor 28.

The speed sensor 28 must be in close proximity to a magnet 30. The magnet 30 closes one switch at a time inside the speed sensor 28 upon rotation of the coupler device 26. The opening and closing of the switches inside the speed sensor 28 provide a change in electrical signal output. The motor drive shaft 20 of the electric motor 10 is coupled to the pump drive shaft 22 of the oil pump 12 with the coupler device 26. A motor shaft cavity 21 is disposed in one end of the coupler device 26 and is sized to receive the outer perimeter of the motor drive shaft 20. A pump shaft cavity 23 is disposed in the other end of the coupler device 26 and is sized to receive the outer perimeter of the pump drive shaft 22. The magnet 30 is preferably embedded in the coupler device 26. The rotation of the magnet 30 causes a change in electrical signal output in the speed sensor 28. The electrical signal produced by the magnet's rotation is used to determine the speed of the motor shaft 20. Rotation of the pump drive shaft 22 pulls oil into inlet tube 32 and forces oil out of the outlet tube 34 of the oil pump 12.

Figure 3:
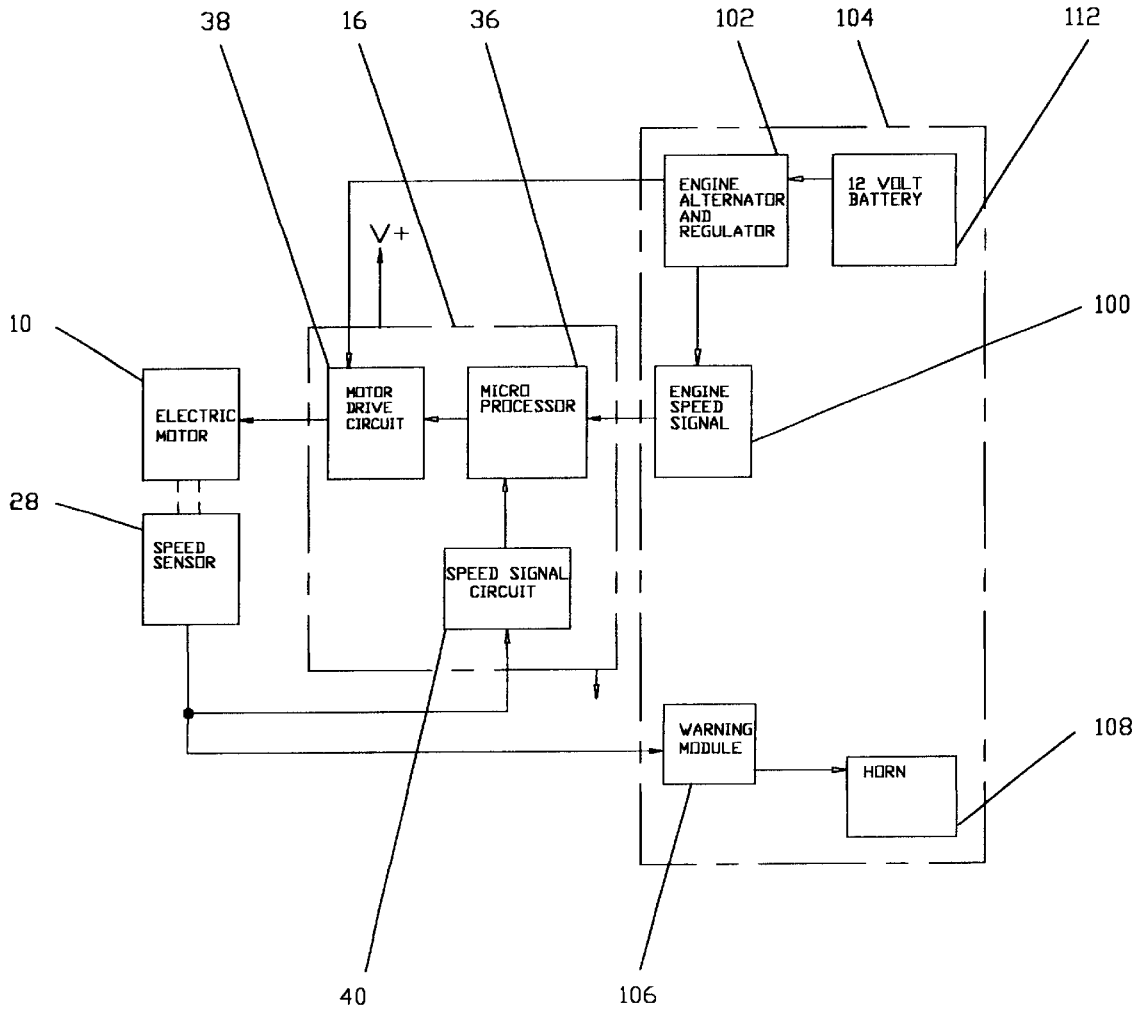
FIG. 3 is a block diagram of the first embodiment of the electrical control of the electric motor by the programmable controller in accordance with the present invention.

FIG. 3 shows a block diagram of the first embodiment of the electrical control of the electric motor 10 by the programmable controller 16. The programmable controller 16 includes a microprocessor 36, a motor drive circuit 38, and a speed signal processing circuit 40. The programmable computer controlled electric oil pump drive for engines 1 operates in the following manner. The microprocessor 36 receives an engine speed signal 100 from an engine alternator 102 in the engine electrical system 104. The microprocessor 36 counts the rate of pulses it receives to determine speed of the engine. In response to the engine speed, the microprocessor 36 instructs the motor drive circuit 38 to source a particular value of voltage to the electric motor 10. The engine battery 112 provides the source of voltage to the motor drive circuit 38. The speed sensor 28 provides the speed of the motor through an electrical signal generated by the rotation of the magnet 30. The speed sensor 28 is tapped to obtain the speed signal for input into the speed signal processing circuit 40. The speed signal of the electric motor 10 is input into the speed signal processing circuit 40 for input into the microprocessor 36.

The oil pump 12 is preferably run according to a look-up table or algorithm programmed into the microprocessor. The programmable controller supplies the electric motor with voltage to achieve a particular fuel to oil ratio at a particular engine speed.

The following look-up table is given by way of example and not by way of limitation.

| Engine Speed | Fuel Usage | Fuel/Oil Ratio | Motor/Pump Speed |
|---|---|---|---|
| 700 rpm | 1.3 gals/hour | 80:1 | 300 rpm |
| 1000 rpm | 2.1 gals/h6ur | 70:1 | 400 rpm |
| 2500 rpm | 9.0 gals/hour | 60:1 | 1300 rpm |
| 3500 rpm | 15.0 gals/hour | 50:1 | 1800 rpm |
| 4500 rpm | 18.0 gals/hour | 50:1 | 2250 rpm |
| 5500 rpm | 21.0 gals/hour | 50:1 | 3000 rpm |

Other values of engine speed, fuel usage, and fuel/oil ratio could also be used. The value of voltage applied to the motor is that which produces the fuel/oil ratio for a particular engine speed. If the speed of the electric motor 10 is too slow in comparison to the speed of the engine, the microprocessor 36 will increase the value of voltage to the electric motor 10. Increasing the value of voltage, increases the speed of the electric motor 10. The microprocessor 36 waits some period of time, then samples the speed of the electric motor 10. If the speed is too high, the value of the voltage sourced to the electric motor 10 will be reduced. If the required speed is not reached, the motor drive circuit 38 will cease supplying the electric motor with current. The warning module 106 will activate an audible horn 108 if a speed signal is not received from the speed sensor 28. The coupler device from the outboard engine is used for the coupler device 26.

The first embodiment of the programmable computer controlled electric oil pump drive for engines 1 is used on Mercury/Mariner outboard engines. The oil pump from the engine is preferably utilized. A cover is placed over an opening created by removal of the oil pump. The cover contains any oil leakage from the crankcase. The speed sensor from the outboard engine is used for the speed sensor 28.

Figure 4:
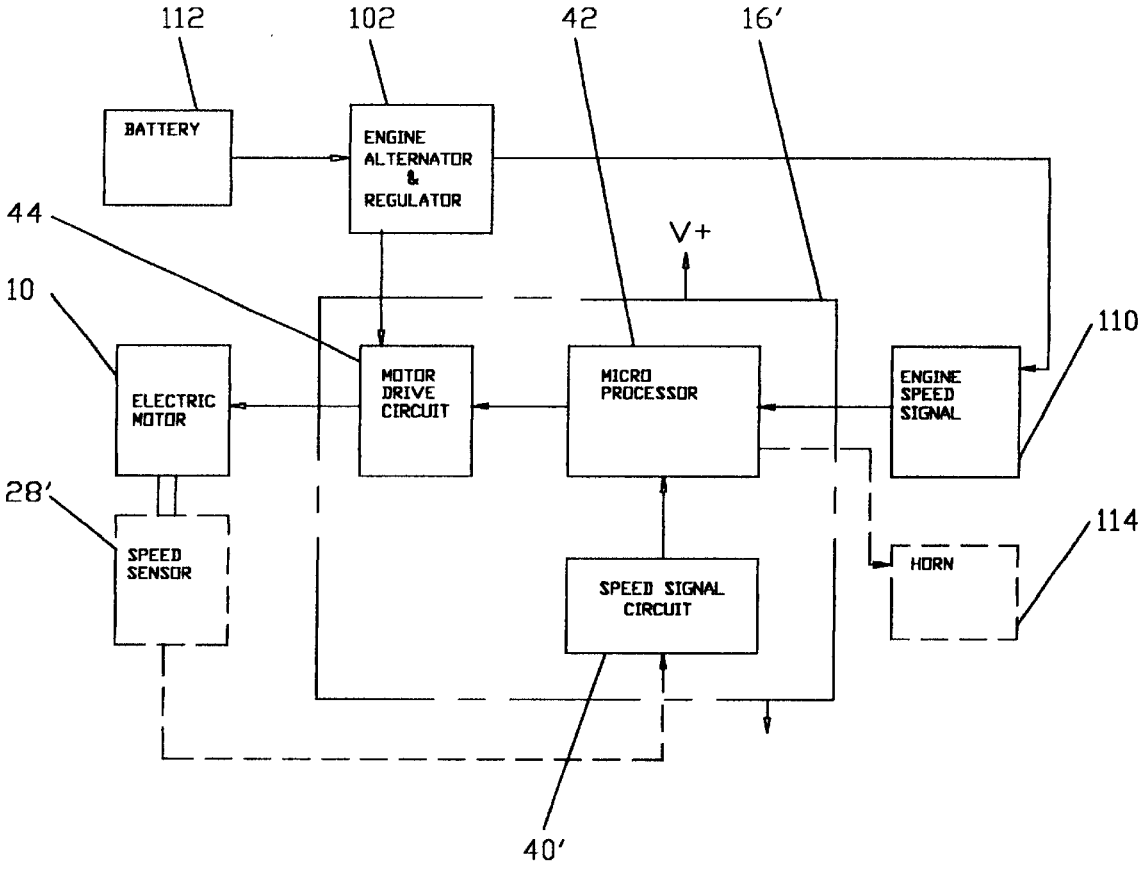
FIG. 4 is a block diagram of the second embodiment of the electrical control of the electric motor by the programmable controller in accordance with the present invention.

FIG. 4 shows a block diagram of the second embodiment of the electrical control of the electric motor 10 by the programmable controller 16'. The coupler from the outboard engine is used as the coupler device 26. The programmable controller 16' includes a microprocessor 42 and a motor drive circuit 44. The programmable computer controlled electric oil pump drive for engines 2 operates in the following manner. The microprocessor 42 receives an engine speed signal 110 from the engine alternator 102 in the engine electrical system. The microprocessor 42 counts the rate of pulses it receives to determine speed of the engine. In response to the engine speed, the microprocessor 42 instructs the motor drive circuit 44 to source a particular value of voltage to the electric motor 10. The particular value of voltage will cause the motor 10 to rotate at speed which will deliver the correct amount of oil to the engine. As the engine speed increases the value of voltage is also increased to cause the oil pump to spin faster and thus pump more oil to the engine. The voltage is decreased as engine speed decreases.

The engine battery 112 provides the source of voltage to motor drive circuit 44 through a voltage regulator. Monitoring the rotation of the motor 10 is optional. If the motor 10 is monitored, a speed sensor 28' and a speed signal processing circuit 40' are used. The microprocessor 42 will also preferably sound a horn 114 to show a failure has occurred similar to the first embodiment.

Figure 5:
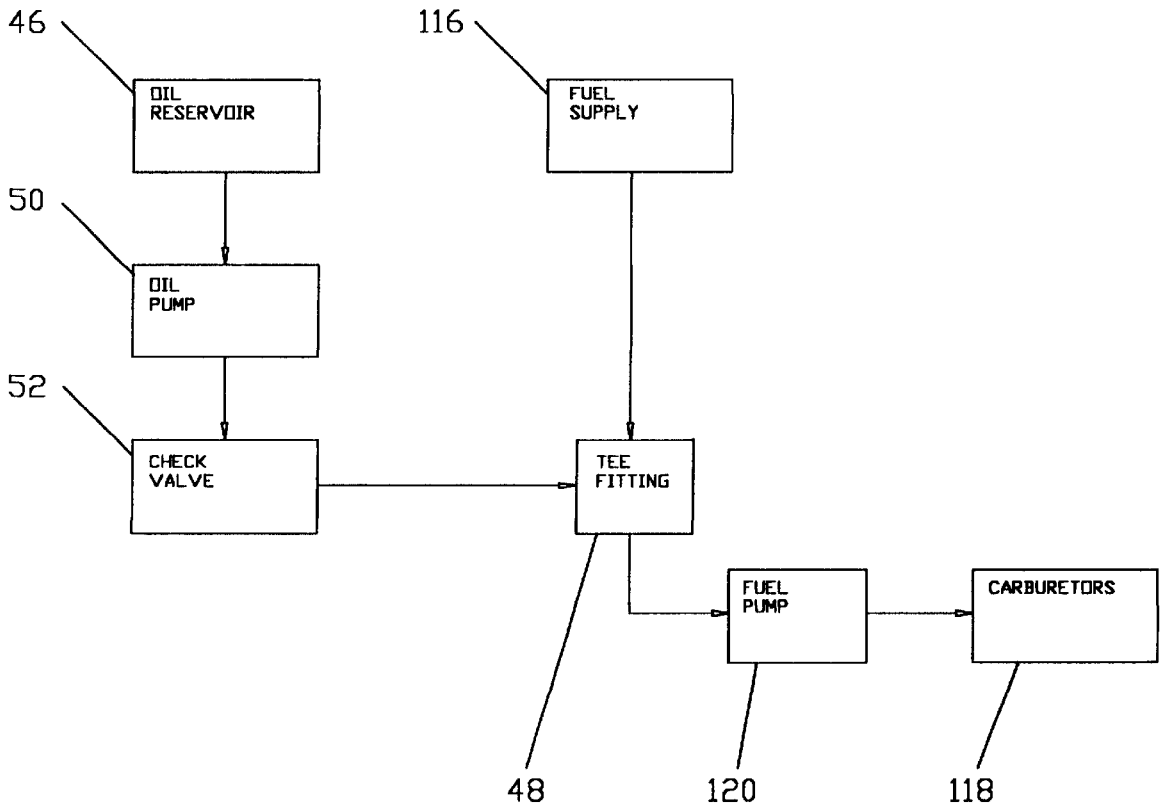
FIG. 5 is a block diagram of oil and fuel mixing in a second embodiment of a programmable computer controlled electric oil pump drive for engines in accordance with the present invention.

The second embodiment of the electric motor driven oil pump for engines is used on non-oil injected engines. With reference to FIG. 5, an oil reservoir 46 supplies oil to an oil pump 50. The oil travels through a check value 52 and combines with fuel from a fuel supply 116 in tee fitting 48.

The fuel and oil mixture is pumped into the carburetor(s) 118 of the engine through a fuel pump 120. The fuel/oil mixture is changed by decreasing or increasing the speed of the oil pump 50 similar to the first embodiment.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A programmable computer controlled electric oil pump drive for engines comprising:

an electric motor having a motor drive shaft;

an oil pump having a pump drive shaft;

a coupler device having two ends, one end of said coupler device retaining said motor drive shaft, the other end of said coupler device retaining said pump drive shaft;

a programmable controller supplying said electric motor with voltage, said programmable controller receiving the speed of the engine and supplying a particular value of voltage to said electric motor according to a look-up table or an algorithm in said programmable controller;

a magnet being attached to said coupler device; and a speed sensor being mounted such that thereof produces an electrical signal in response to the rotation of said magnet, said electrical signal being input into said programmable controller.

2. The programmable computer controlled electric oil pump drive for engines of claim 1, wherein:

said programmable controller changing the value of voltage sourced to said electric motor if the speed thereof is not consistent with said look-up table or said algorithm.

3. The programmable computer controlled electric oil pump drive for engines of claim 1, further comprising:

a motor drive circuit receiving a particular value of engine speed and in response to said particular value of engine speed, sourcing a particular value of voltage to said electric motor.

4. The programmable computer controlled electric oil pump drive for engines of claim 1, further comprising:

a coupler housing having two ends, said electric motor being attached to one end of said coupler housing and said oil pump being attached to the other end of said coupler housing.

5. The programmable computer controlled electric oil pump drive for engines of claim 4, further comprising:

said coupler housing and said programmable controller being attached to a mounting plate.

6. A programmable computer controlled electric oil pump drive for engines comprising:

an electric motor having a motor drive shaft;

an oil pump having a pump drive shaft;

a coupler device having two ends, one end of said coupler device having a cavity which is sized to receive said motor drive shaft, the other end of said coupler device having a cavity which is sized to receive said pump drive shaft, said coupler device having a magnet attached thereto;

a programmable controller supplying said electric motor with voltage, said programmable controller receiving the speed of the engine and supplying a particular value of voltage to said electric motor according to a look-up table or an algorithm in said programmable controller; and a speed sensor being mounted such that thereof produces an electrical signal in response to the rotation of said magnet, said electrical signal being input into said programmable controller, said programmable controller changing the value of voltage sourced to said electric motor if the speed thereof is not consistent with said look-up table or said algorithm.

7. The programmable computer controlled electric oil pump drive for engines of claim 6, further comprising:

a motor drive circuit receiving a particular value of engine speed and in response to said particular value of engine speed, sourcing a particular value of voltage to said electric motor.

8. The programmable computer controlled electric oil pump drive for engines of claim 6, further comprising:

a coupler housing having two ends, said electric motor being attached to one end of said coupler housing and said oil pump being attached to the other end of said coupler housing.

9. The programmable computer controlled electric oil pump drive for engines of claim 8, further comprising:

said coupler housing and said programmable controller being attached to a mounting plate.

10. A programmable computer controlled electric oil pump drive for engines comprising:

an electric motor having a motor drive shaft;

an oil pump having a pump drive shaft;

a reservoir for retaining a quantity of oil;

a device for combining a portion of said quantity of oil with a portion of fuel;

a coupler device having two ends, one end of said coupler device retaining said motor drive shaft, the other end of said coupler device retaining said pump drive shaft;

a programmable controller supplying said electric motor with voltage, said programmable controller receiving the speed of the engine and supplying a particular value of voltage to said electric motor according to a look-up table or an algorithm in said programmable controller;

a magnet being attached to said coupler device; and a speed sensor being mounted such that thereof produces an electrical signal in response to the rotation of said magnet, said electrical signal being input into said programmable controller.

11. The programmable computer controlled electric oil pump drive for engines of claim 10, wherein:

said programmable controller changing the value of voltage sourced to said electric motor if the speed thereof is not consistent with said look-up table or said algorithm.

12. The programmable computer controlled electric oil pump drive for engines of claim 10, further comprising:

a motor drive circuit receiving a particular value of engine speed and in response to said particular value of engine speed, sourcing a particular value of voltage to said electric motor.

13. The programmable computer controlled electric oil pump drive for engines of claim 10, further comprising:

a coupler housing having two ends, said electric motor being attached to one end of said coupler housing and said oil pump being attached to the other end of said coupler housing.

14. The programmable computer controlled electric oil pump drive for engines of claim 13, further comprising:

said coupler housing and said programmable controller being attached to a mounting plate.

15. A method of providing oil injection to an engine utilizing an electric motor driven oil pump, comprising the steps of:

(a) providing an oil pump;

(b) coupling said oil pump to an electric motor;

(c) providing a programmable controller which receives a speed signal from the engine;

(d) sourcing said electric motor with a value of voltage which is proportional to the speed of said engine; and (e) changing the value of voltage sourced to said electric motor if the speed thereof is not consistent with a look-up table or an algorithm.

16. The method of providing oil injection to an engine utilizing an electric motor driven oil pump of claim 15, further comprising the steps of:

(e) providing a reservoir for retaining a quantity of oil; and (f) providing a device for combining a portion of said quantity of oil with a portion of fuel.

* * * * *